US005746031A

United States Patent [19]

Burns

[11] Patent Number: 5,746,031

[45] Date of Patent: May 5, 1998

[54] WILD FIRE SUPPRESSOR FOR UTILITY POLES

[76] Inventor: James M. Burns, P.O. Box 812, Milton-Freewater, Oreg. 97862

[21] Appl. No.: 837,544

[22] Filed: Apr. 21, 1997

[51] Int. Cl.[6] ..... A62C 2/00

[52] U.S. Cl. ..... 52/170; 52/169.13; 52/517; 52/737.5; 52/736.4; 52/738.1; 248/519; 47/24

[58] Field of Search ..... 52/169.13, 169.14, 52/170, 219, 738.1, 737.5, 736.4, 517; 47/23–25, 30; 248/519, 523, 530

[56] References Cited

U.S. PATENT DOCUMENTS

| | | | |
|---|---|---|---|
| 405,658 | 6/1889 | Campany . | |
| 494,874 | 4/1893 | Majola . | |
| 561,391 | 6/1896 | Greene . | |
| 574,998 | 1/1897 | Kent et al. . | |
| 1,517,846 | 12/1924 | Lewis . | |
| 1,521,285 | 12/1924 | Erickson . | |
| 1,532,734 | 4/1925 | Dean . | |
| 1,982,562 | 11/1934 | Byrd . | |
| 3,571,972 | 3/1971 | Carter | 47/25 |
| 4,845,889 | 7/1989 | Taylor . | |
| 4,922,652 | 5/1990 | Graves . | |
| 4,937,991 | 7/1990 | Orth | 52/219 X |
| 5,048,229 | 9/1991 | Campbell . | |
| 5,311,713 | 5/1994 | Goodrich . | |
| 5,367,822 | 11/1994 | Beckham | 47/25 |
| 5,568,909 | 10/1996 | Timko | 248/530 X |

*Primary Examiner*—Robert Canfield
*Attorney, Agent, or Firm*—Robert D. Varitz

[57] ABSTRACT

A wild fire suppressor includes a base wrap, including a fire-resistant, groundcontour-following base panel for installation about the base of a utility pole, and base panel anchors for holding the base panel in place on the ground. A pole wrap includes a rigid pole panel, and fasteners for fastening the pole panel to the utility pole.

16 Claims, 2 Drawing Sheets

WILD FIRE SUPPRESSOR FOR UTILITY POLES

FIELD OF THE INVENTION

This invention relates to protective devices for utility poles, specifically to a wild fire suppressor which may be used to protect utility poles from fire.

BACKGROUND OF THE INVENTION

Wild fires, or range fires, are a common problem throughout the western United States and other semi-arid regions of the world. As population expands into such areas, utilities must be provided, such as electrical and telephone service, which utilities require the stringing of wires on utility poles. Utility poles are generally wooden structures, wherein the wood is treated to resist insect damage and to resist the rotting effects of water. However, such treatment also tends to make the utility poles more susceptible to fire, as such treatments generally involve some form of petro-chemicals which are impregnated into the wood of the utility pole.

Range fires are a direct result of poor range management and poor timber practices. Grazing practices throughout the western states tends to promote the development of vegetation such as cheatgrass and foxtail, while the natural grasses have tended to disappear. The areas that are of concern are the relatively arid regions of the western United States. These regions are known for temperature extremes, frequently reaching temperature in excess of 100° F. during the day, and dipping into the 20's or 30's at night. These temperatures, along with low humidity, promote rapid drying of vegetation, and are quite harsh on the wooden material of utility poles. When cheatgrass or foxtail grows around power poles, a mat of dead and dry grass builds up, which mat may rapidly flame when the surrounding air temperature is high, the humidity is low, and any form of spark reaches the mat. Under these circumstances, the mat surrounding a utility pole will produce temperatures in excess of 2,000° Fahrenheit in a very short period of time. While the dead and dry grass generally burns quite rapidly, and for a short period of time, such a burn is sufficient to set utility poles on fire. Although such fire hazards could be avoided by maintaining a clear area around the base of a utility pole, such clearing is exceptionally labor intensive and is not performed on a regular basis.

A number of fire suppressors for use on utility poles are known from the prior art. Erickson, U.S. Pat. No. 1,521,285, discloses a two-piece protector for a telephone and telegraph pole, which protector is secured about the base of the pole and extends below ground level. In addition to protecting the pole against fire, this device is also intended to strength the pole and to retard ground-line rotting.

Lewis, U.S. Pat. No. 1,517,846 discloses another two-piece utility pole shield which is intended to protect the pole from fire. A number of other pole protectors are known, however, none of those protectors are particularly easy to install, and none of them provide a clear area around the base of a pole to prevent the accumulation of potentially incendiary material.

SUMMARY OF THE INVENTION

The wild fire suppressor of the invention includes a base wrap, including a fireresistant, ground-contour-following base panel for installation about the base of a utility pole, and base panel anchors for holding the base panel in place on the ground. A pole wrap includes a rigid pole panel, and fasteners for fastening the pole panel to the utility pole.

An object of the invention is to provide a wild fire suppressor which will maintain a clear area, free of grasses and weeds, about the base of a utility pole, to prevent range fires from starting a fire on a utility pole.

Another object of the invention is to provide a fire suppressor which is easily installed and which is economical to manufacture.

A further object of the invention is to provide a fire suppressor having variable configurations, which may be useable with a variety of utility pole arrangements.

These and other objects and advantages of the invention will become more fully apparent as the description which follows is read in conjunction with the drawings.

DETAILED DESCRIPTION OF THE PREFERRED EMBODIMENTS

Figure 1:
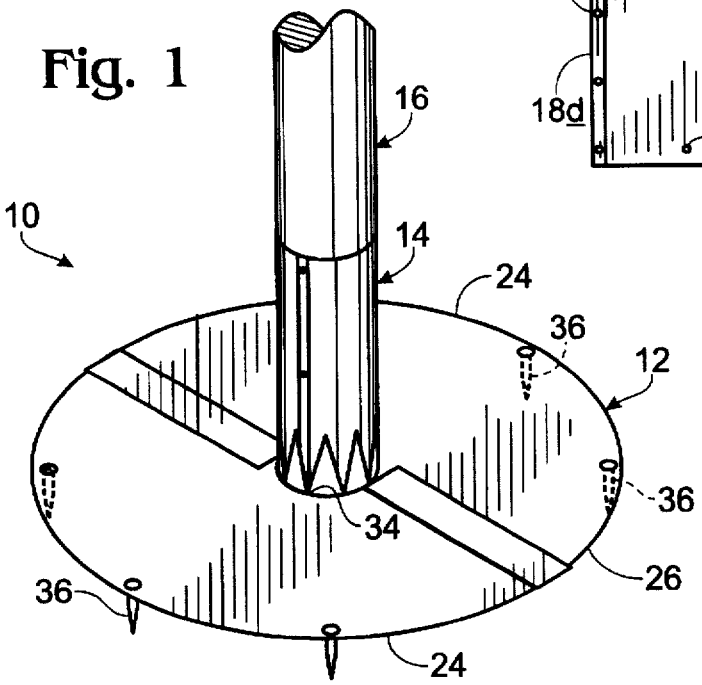
FIG. 1 depicts the wild fire suppressor of the invention installed on a utility pole.

Referring now to the drawings, and initially to FIG. 1, a wild fire suppressor constructed according to the invention is depicted generally at 10. Suppressor 10 includes a base wrap 12 and a pole wrap 14, which, in combination, serve to keep grass and weeds, and other vegetation, from growing close to a utility pole 16.

Figure 2:
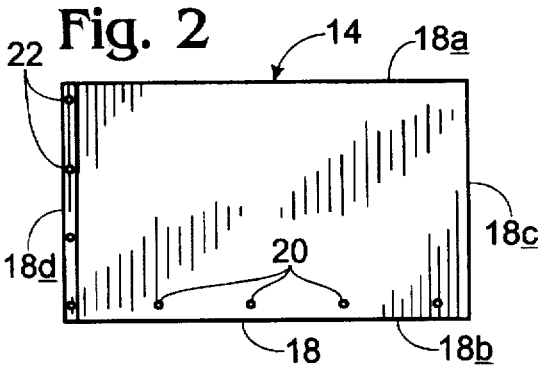
FIG. 2 depicts a pole panel of the invention.

Referring now to FIGS. 1 and 2, pole wrap 14 will be described in greater detail. In the preferred embodiments, pole wrap 14 includes a pole panel 18, which is generally rectangular in shape, and which, while formed of generally rigid material, such as sheet metal, is bendable into a generally cylindrical shape, having an open top and an open bottom. Pole panel 18 has an upper edge 18*a*, a lower edge 18*b*, a vertical free edge 18*c* at one end thereof, and a lapped edge 18*d* at the other vertical edge thereof. Pole panel 18 is a fire-resistant, rigid structure which will protect the upright portion of utility pole 16 from the effects of a range fire. In the preferred embodiment, pole panel 18 is formed of 26 gauge galvanized metal and has a vertical height of between 2 and 3 feet, and a length sufficient to wrap around a standard 12 inch diameter utility pole. Bores 20 are formed in panel 18 to allow air circulation between the panel and pole 16. Another set of bores 22 are formed in lapped edge 18*d* to provide fastening of lapped edge 18*d* to free edge 18*c*, thereby completely surrounding utility pole 16.

Figure 3:
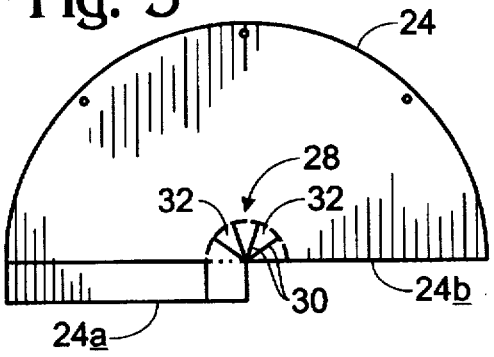
FIG. 3 depicts a base panel of the invention.

Referring now to FIGS. 1 and 3, a base-panel segment 24 is depicted. Generally, base wrap 12 includes at least two base-panel segments, which are identically formed structures, and which may be joined together to form a base panel 26. Base panel segment 24 includes a lapped edge 24*a*, an edge conformal with the lapped edge 24*b*, and an open portion, shown generally at 28. In the preferred embodiment, open portion 28 is precut, as indicated by lines 30, to allow flanges 32 to be folded upwardly, thereby forming an open area 34, which fits about the base of a utility pole 16. Flanges 32 are bent upwards and are fixed about the base of utility pole 16, and are enclosed by pole wrap 14. Flanges 32 serve a dual function: first, they serve to help hold pole wrap 14 in place, and, second, they may be attached to utility pole 16 by fasteners to help hold the base wrap in place.

Lapped edge 24*a* and conformal edge 24*b* may simply overlap one another, in which case they are joined together by sheet-metal screws, or may be formed, using conventional sheet metal joining techniques, into interlocking edges. The joint between lapped edge 24*a* and conformal edge 24*b* serves as an expansion joint, to allow base wrap 12 to change sizes without distortion as the ambient temperature raises and lowers, and to make the fire suppressor more adaptable for use on different size utility poles.

Base panel anchors 36 are provided to secure base panel 26 in place on the ground. Base panel anchors 36 may take the form of spikes, as depicted in the drawings, or may include a screw-like configuration, such as a galvanized screw nail, depending on the soil type to which the base panel is anchored. Galvanized material should be used for anchors 36.

In the preferred embodiment, base panel segments 24 are manufactured to provide a 4 to 6 foot radius about the base of utility pole 16, and are formed of 20 gauge galvanized metal. Although the figures depict the use of two base-panel segments to form base panel 26, it will be appreciated by those of ordinary skill in the art that more base-panel segments could be used to facilitate easier handling or for manufacturing cost requirements.

Figure 4A:
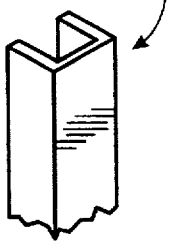
FIG. 4*a* depicts a spacer used with the pole panel of the invention.
Figure 4:
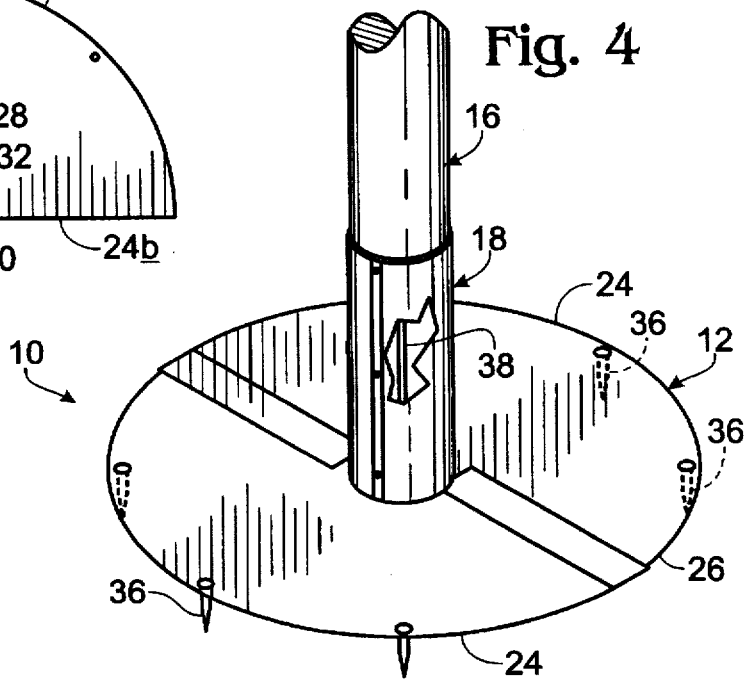
FIG. 4 depicts a second embodiment of the invention.

Referring now to FIG. 4 and FIG. 4*a*, a pole-wrap spacer is depicted at 38. Spacer 38 is provided to provide an air space between utility pole 16 and pole panel 18, and may have a "U" shape, or may be formed of angle material. Spacer 38 is formed, in the preferred embodiment, from 20 gauge material. Spacers 38 are particularly useful when the fire suppressor is used in area that may have a higher relative humidity, in order to provide an air space to allow the utility pole to dry out.

Figure 5:
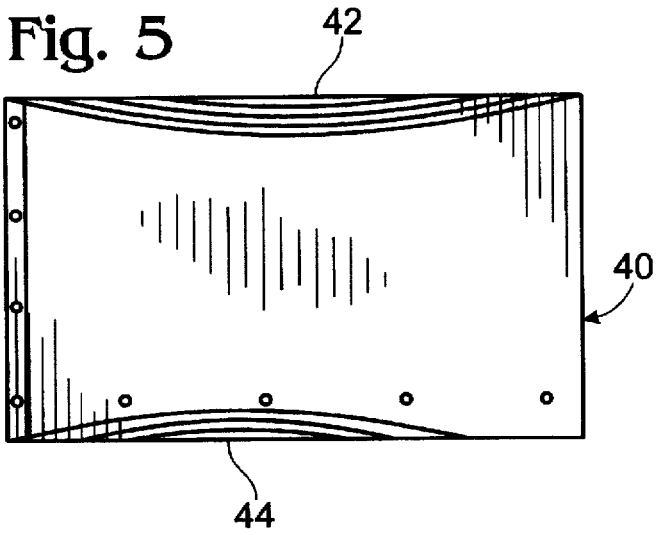
FIG. 5 depicts an alternate embodiment of the pole panel of the invention.

Referring now to FIG. 5, a modified form of the pole panel of the invention is depicted generally at 40. Pole panel 40 includes hillside conformal indicia, indicated generally at 42 and 44. Indicia 42 and 44 may take the form of scores which are formed in the fabric of pole panel 40, or may simply be marks printed on pole panel 40 to provide a guideline for cuts which may be made to make pole panel 40 conform to sloped terrain in the case where utility pole 16 is located on a hillside. Indicia 42, as depicted, are used for larger diameter poles, having a diameter greater than 14 inches. Indicia 44 are intended for use on poles having a 12 inch to 14 inch diameter. Cuts may be made along an appropriate indicia to match the slope of the terrain, thereby eliminating the need to remove soil from around the base of utility pole 16 during installation of suppressor 10.

Figure 5A:
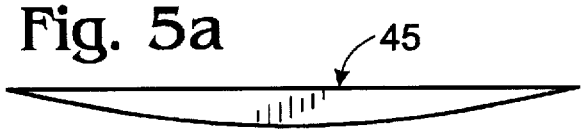
FIG. 5*a* depicts a hillside-extender for the pole panel of the invention.

An alternate structure for use on a hillside is the hillside extender depicted at 45 in FIG. 5*a*. When extender 45 is used, a standard, rectangular pole panel is installed, with the up-hill bottom edge of the pole panel being located at ground level. Extender 45 is located about the base of the utility pole to fill in the down-hill and lateral sides of the utility pole. Extender 45 may be provided in a variety of widths, having different radii, to provide a fill in depending on the slope of the terrain.

Figure 6:
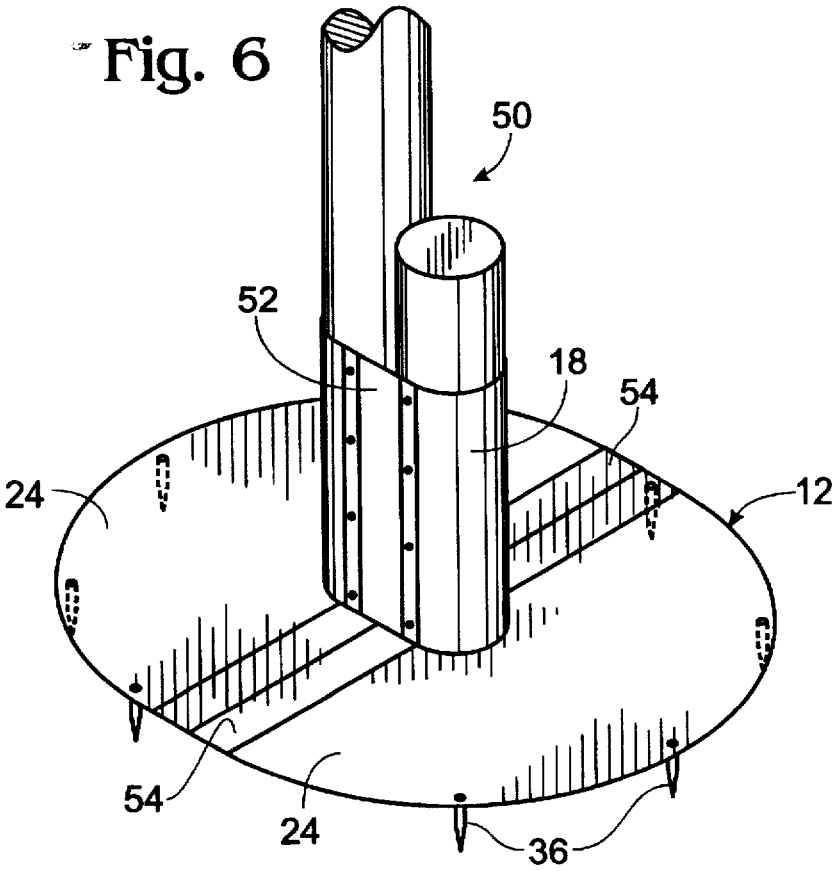
FIG. 6 depicts the wild fire suppressor of the invention installed on a double utility pole arrangement.

Referring now to FIG. 6, a double utility pole arrangement is depicted generally at 50. Extenders are provided for both pole panel 18 and base panel 26. Specifically, a pole panel extender 52 is provided to lengthen pole panel 18, while a base panel extender 54 is provided to provide a substantially straight run between two base-panel segments.

To install the wild fire suppressor of the invention, the ground around the utility pole is initially cleared of grasses, shrubs, and other debris and then smoothed to provide a flat surface for base wrap 12. Flanges 32 are bent up around the base of utility pole 16 and the base panel then anchored to the ground by means of base panel anchors 36. If they are used, spacers 38 are then placed about the outer surface of utility pole 16 and secured to the pole by means of screws or other suitable fasteners. Spacers 38 are distributed evenly about the surface of utility pole 16, with at least three, and usually six, spacers being used. Pole panel 18 is then wrapped about utility pole 16 and lapped edge 18*d* secured over free edge 18*c*, by screws or other suitable fasteners. In the event that the utility pole is located on sloping terrain, a pole panel, such as pole panel 40 is used, and the panel is cut to conform to the terrain. Suppressor 10 provides a 4 to 6 foot diameter circle about the base of utility pole 16 to prevent the growth of grass and other vegetation about the base of utility pole 16 and to prevent any material from burning within a specified distance of the pole in the event of a wild fire. Additionally, base wrap 12 will keep the earth around the base of utility pole 16 relatively dry, which is estimated to provide a 10 to 20 percent longer pole life.

Thus, a wild fire suppressor has been disclosed which may be easily installed about existing utility poles and which will effectively prevent the poles from catching fire in the case of a range fire. Although a preferred embodiment of the invention and a variation thereof have been disclosed, it should be appreciated that further modifications and variations may be made thereto without departing from the scope of the invention as defined in the appended claims.

I claim:

1. A wildfire suppressor for use with a utility pole, comprising:

a base wrap including a fire-resistant, base panel for installation on a ground surface about the base of a utility pole, and base panel anchors for holding said base panel in place on the ground surface; and a pole wrap including a fire-resistant, substantially rigid pole panel, and fasteners for fastening said pole panel to the utility pole and a base panel extender for increasing the surface area of said base panel.

2. The wildfire suppressor of claim 1 wherein said base panel includes a open portion therein, which open portion is conformal with the utility pole, and wherein upwardly extending flanges project upwardly about the periphery of said open portion, which flanges extend upward inside said pole panel.

3. The wildfire suppressor of claim 1 wherein said base panel is formed from at least two base-panel segments, wherein said base-panel segments are identically formed structures, and which further include at least one lapped edge per segment for joining to a conformal edge of an adjacent segment.

4. The wildfire suppressor of claim 1 wherein said pole panel is formed into a substantially cylindrical structure, having an open top and an open bottom, and which includes a lapped edge for joining with a free edge of a pole panel.

5. The wildfire suppressor of claim 1 wherein said pole panel includes hillside-conformal indicia along at least one horizontal edge thereof facilitating conforming said pole panel to terrain surrounding a utility pole.

6. The wildfire suppressor of claim 1 which further includes spacer elements for spacing said pole panel a predetermined distance from the outer surface of a utility pole.

7. A wildfire suppressor for use with a utility pole, comprising:

a base wrap including a fire-resistant, substantially circular base panel for installation on a ground surface about the base of a utility pole, and base panel anchors for holding said base panel in place on the ground surface, wherein said base panel is formed from at least two base-panel segments, wherein said base-panel segments are identically formed structures, and which further include at least one lapped edge per segment for joining to a conformal edge of an adjacent segment; and a pole wrap including a fire-resistant, substantially rigid, substantially rectangular pole panel, which when applied to the utility pole, takes the form of a cylinder having an open top and an open bottom, and fasteners for fastening said pole panel to the utility pole.

8. The wildfire suppressor of claim 7 wherein said base panel includes a open portion therein, which open portion is conformal with the utility pole, and wherein upwardly extending flanges project upwardly about the periphery of said open portion.

9. The wildfire suppressor of claim 7 which further includes a base panel extender for increasing the surface area of said base panel.

10. The wildfire suppressor of claim 7 wherein said pole panel includes a lapped edge for joining with a free edge of a pole panel.

11. The wildfire suppressor of claim 7 wherein said pole panel includes hillside-conformal indicia along at least one horizontal edge thereof facilitating conforming said pole panel to terrain surrounding a utility pole.

12. The wildfire suppressor of claim 7 which further includes spacer elements for spacing said pole panel a predetermined distance from the outer surface of a utility pole.

13. A wildfire suppressor for use with a utility pole, comprising:

a base wrap including a fire-resistant, substantially circular base panel for installation on a ground surface about the base of a utility pole, and base panel anchors for holding said base panel in place on the ground surface, wherein said base panel is formed from at least two base-panel segments, wherein said base-panel segments are identically formed structures, wherein said base panel includes a open portion therein, which open portion is conformal with the utility pole, and wherein upwardly extending flanges project upwardly about the periphery of said open portion, and which further include at least one lapped edge per segment for joining to a conformal edge of an adjacent segment; and a pole wrap including a fire-resistant, substantially rigid, substantially cylindrical pole panel, having an open top, an open bottom, and a slit down the side thereof, and further having a lapped edge for joining with a free edge of a pole panel on either side of said slit, and fasteners for fastening said pole panel to the utility pole.

14. The wildfire suppressor of claim 13 which further includes a base panel extender for increasing the surface area of said base panel.

15. The wildfire suppressor of claim 13 wherein said pole panel includes hillside-conformal indicia along at least one horizontal edge thereof facilitating conforming said pole panel to terrain surrounding a utility pole.

16. The wildfire suppressor of claim 13 which further includes spacer elements for spacing said pole panel a predetermined distance from the outer surface of a utility pole.

* * * * *